US005450049A

United States Patent [19]

Bachmann

[11] Patent Number: 5,450,049

[45] Date of Patent: Sep. 12, 1995

[54] SWITCH FOR SIGNALING CHANGES IN POSITION AND ACCELERATIONS

[75] Inventor: Rolf Bachmann, Nürnberg, Germany

[73] Assignee: W. Guenther GmbH, Nürnberg, Germany

[21] Appl. No.: 47,450

[22] Filed: Apr. 15, 1993

[30] Foreign Application Priority Data

Apr. 16, 1992 [DE] Germany ..... 9205276 U

[51] Int. Cl.[6] ..... H01H 9/00

[52] U.S. Cl. ..... 335/205; 200/61.45 R

[58] Field of Search ..... 335/205–207; 200/61.45 R, 61.45 M, 61.48, 61.52, 81.9 M, 82 E, 84 C

[56] References Cited

U.S. PATENT DOCUMENTS

| | | | |
|---|---|---|---|
| 4,016,535 | 4/1977 | Dinlocker | 200/61.52 |
| 4,103,842 | 8/1978 | Martin et al. | 200/61.58 |
| 5,010,216 | 4/1991 | Sewell et al. | 200/61.45 |

*Primary Examiner*—Lincoln Donovan
*Attorney, Agent, or Firm*—Spencer, Frank & Schneider

[57] ABSTRACT

A switch signals changes in position and accelerations of its housing. The switch housing includes a movably mounted permanent magnet and at least one reed switch. The permanent magnet is suspended in the manner of a planar pendulum. The reed switch is disposed in the effective range of the magnetic field below the circle segment described by the pendulum. The longitudinal axis of the reed switch is oriented approximately in the direction of the pendulum oscillations.

20 Claims, 3 Drawing Sheets

FIG. 1
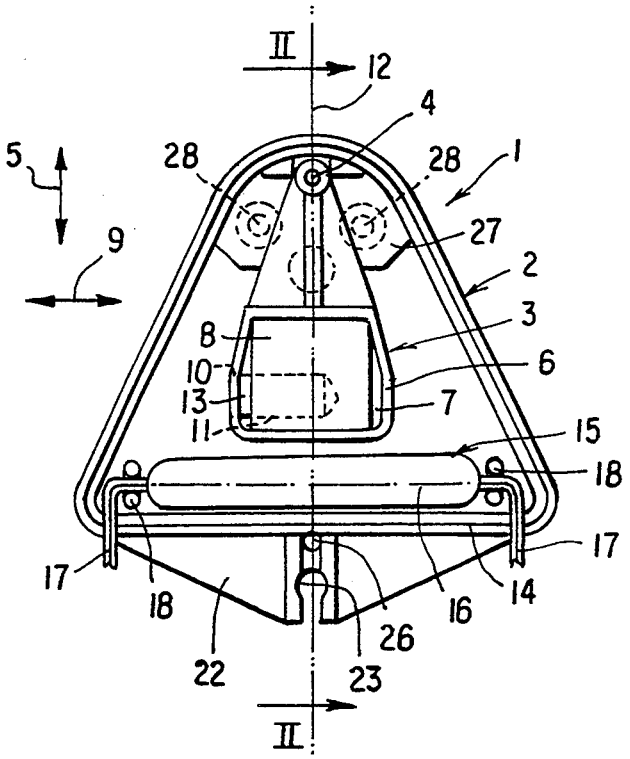
FIG. 2
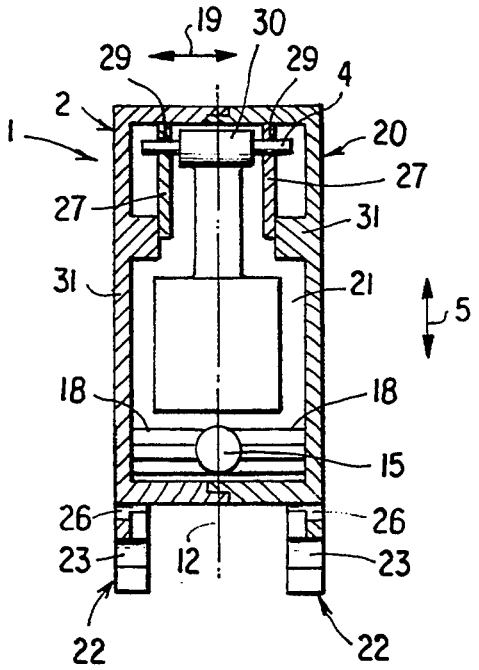
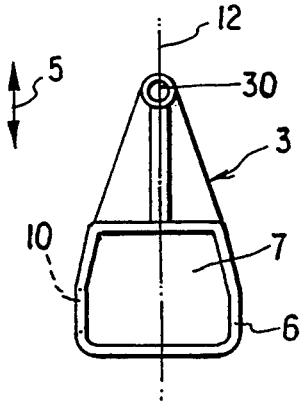
FIG 3
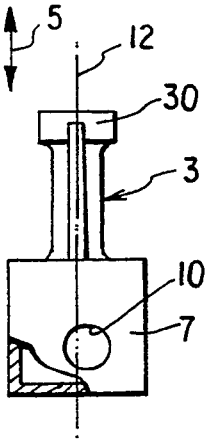
FIG. 4
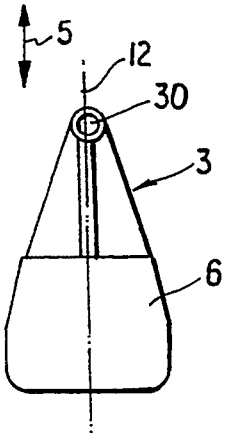
FIG. 5

FIG. 8
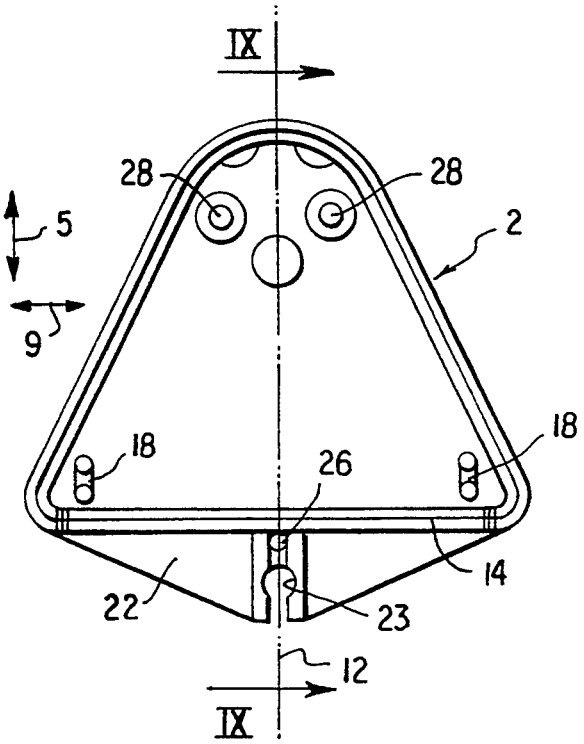
FIG. 9
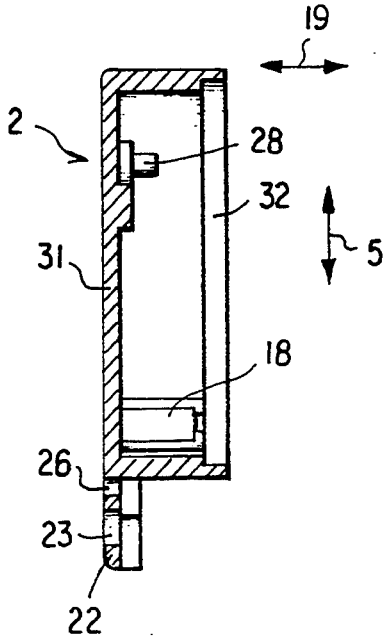
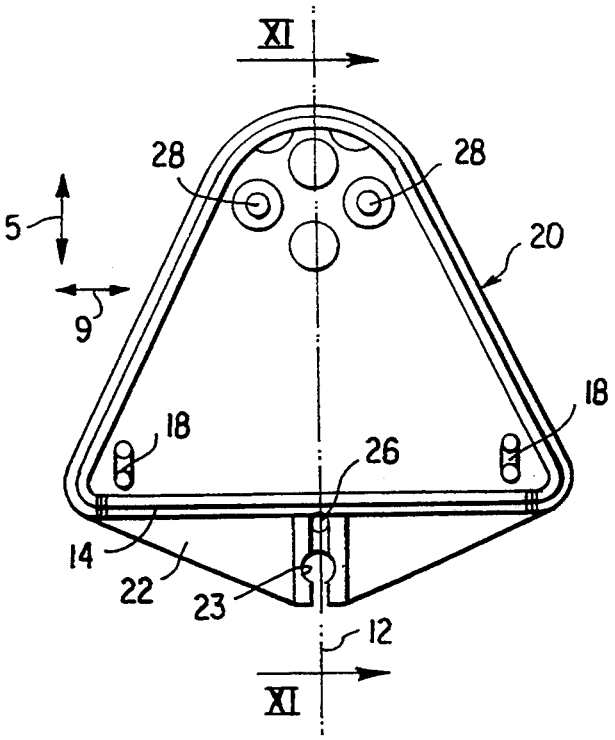
FIG. 10
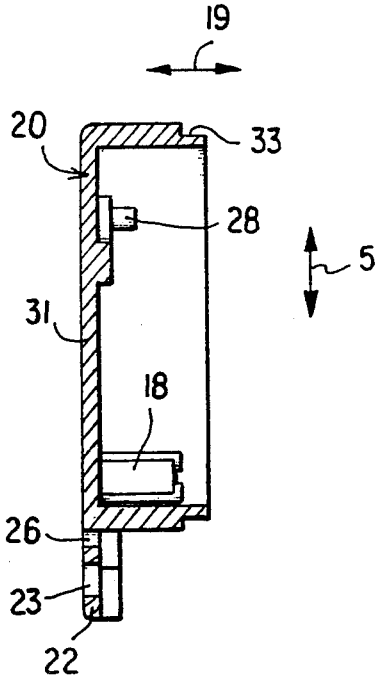
FIG. 11

SWITCH FOR SIGNALING CHANGES IN POSITION AND ACCELERATIONS

BACKGROUND OF THE INVENTION

The invention relates to a switch for signaling changes in the position and accelerations of its housing equipped with a movably mounted permanent magnet and at least one reed switch as active elements, wherein the permanent magnet is suspended in the manner of a pendulum; and the reed switch is disposed below the circle segment described by the pendulum in the effective range of the magnetic field.

Such switches are known per se. They are employed, for example, in motor vehicles where, if a predetermined acceleration or deceleration limit value is exceeded, they are to initiate a switching process, for example, turn on an optical or acoustical signal, inflate a so-called "air bag", or the like. Prior art switches of this type are provided with a mercury switch as the position or acceleration sensitive sensor in which a movably positioned small quantity of mercury short-circuits two electrodes if a predetermined limit value is exceeded.

It is also known to realize the same purpose by replacing the mercury switch with a movably mounted magnet in whose field a reed switch is disposed. If an acceleration or deceleration of predetermined magnitude acts on the magnet, the change in the magnetic field connected therewith causes the reed switch to change its switching state, which can be utilized in the same manner as the switching process of the above-mentioned mercury switch. Position and acceleration sensitive switches equipped with a movably mounted permanent magnet and at least one reed switch as the active elements are disclosed, for example, in German Patent DE 4,032,717.A1. There, the permanent magnet is suspended from a switch housing in the manner of a pendulum. Changes in position and accelerations of the switch housing cause the permanent magnet to move relative to the reference system of the switch housing and in this way, at certain limit values of position change or acceleration, cause a change in the switching state of the reed switch which is stationarily fixed to the switch housing.

Some of the prior art arrangements composed of a permanent magnet and a reed switch are of extremely complicated construction or, because of the arrangement of their active elements, they have a high response threshold or an unduly high hysteresis in their turn-on and turn-off processes.

SUMMARY OF THE INVENTION

It is the object of the invention to further develop the prior art position and acceleration sensitive switches equipped with a movably mounted permanent magnet and at least one reed switch as active elements with the aim of simplifying their configuration, increasing the accuracy of their response and reducing their turn-on and turn-off hysteresis. The above and other objects are accomplished in accordance with the invention by the provision of a switch for signalling changes in position and acceleration of its housing, comprising: a switch housing; a permanent magnet movably mounted in the switch housing and being suspended in the manner of a planar pendulum for oscillatory movement about a pendulum axis in a pendulum plane; and a reed switch disposed in the switch housing below a circle segment described by the pendulum in an effective range of the magnetic field the permanent magnet, the reed switch having a longitudinal axis that is oriented approximately in the direction of the pendulum oscillations.

With this arrangement it becomes possible for the switch, on the one hand, to respond already at relatively small accelerations or decelerations, that is, to be highly sensitive. On the other hand, however, due to the longitudinal orientation of the reed switch in the direction of oscillation, its magnetizable components act as a magnetic brake and to some extent additionally as an eddy current attenuation so that wild oscillations of the pendulum-suspended magnet are suppressed.

The orientation of the reed switch additionally permits a space saving configuration for the switch housing which accommodates the reed switch and the permanent magnet. The pivoting range of the pendulum must be considered in any case when dimensioning the switch housing. Therefore, no additional space is required for the longitudinal orientation of the reed switch.

Transversely to its longitudinal orientation the reed switch can also be installed in a position in which it is pivoted by a certain angular degree about an imaginary extension of the longitudinal axis of the pendulum at rest without adversely influencing the narrow configuration of the switch housing.

A special arrangement of the permanent magnet so that its polarization direction lies in the pendulum plane, ensures; the necessary influence on the switching state of the reed switch. In addition, in many embodiments of permanent magnets, the magnetization direction lying in the plane of the pendulum enhances the narrow construction of the switch housing.

The polarization direction of the permanent magnet and the longitudinal axis of the reed switch as advantageously arranged. According to one arrangement, the hysteresis of the magnetizable components of the reed switch is reduced further so that an improvement is realized in the response accuracy and the response sensitivity of the switch. The improved response characteristics of the switch permit the use of a shorter pivoting path for the permanent magnet along its pendulum plane while still retaining sufficient response accuracy and sensitivity. The shorter pivoting path in turn permits a shorter pendulum length. As a whole, this further reduces the space required for the switch housing.

According to a further aspect of the invention, the permanent magnet is a rod magnet. Rod magnets can be produced in very small dimensions so that they are suitable particularly for the purpose proposed here. All known magnetic materials may be employed. An effective fixing of the permanent magnet within the switch housing ensures that the permanent magnet performs the necessary pendulum oscillations. As an injection molded plastic component the pendulum frame can be produced easily and economically. Since the pendulum frame has a certain degree of mechanical stability, wild oscillations of the permanent magnet can be attenuated.

Preferably, the pendulum housing for the permanent magnet is shaped to the end region of the pendulum frame facing the reed switch. Thus the center of gravity of the pendulum lies very low, further improving its attenuation characteristics. The low arrangement of the pendulum housing also enables the permanent magnet to exert an improved influence on the reed switch.

The masses of the pendulum frame and of the pendulum housing itself also act as attenuation for the pendulum oscillations.

If the inherent masses of the pendulum frame, the pendulum housing and the permanent magnet are insufficient, it is of advantage to arrange at least one further body in addition to the permanent magnet in the pendulum housing, thus enabling the adjustment range to be broadened considerably.

By varying the masses, different pendulum characteristics such as, for example, actuation characteristic and attenuation, can be realized with the same pendulum structure. With geometrically differently configured bodies it is possible to change the coordinates of the center of gravity. In this way, the characteristics can also be changed in a simple manner.

According to another aspect of the invention, the further; body and permanent magnet are fixed in a mechanically stable manner. The installation of such a pendulum is also simplified.

In order to configure the proposed switch as an easily manipulated component, the functional components, namely the pendulum frame together with the permanent magnet and possibly additional bodies, on the one hand, and the reed switch, on the other hand, are combined to form a structural unit within the snitch housing.

The switch housing is equipped with connecting elements in the form of connector pins, solder pins or cables so that the entire switch can be arranged as a functional component on printed circuit boards or in other electrical or electronic circuits. The simple bending of the connector pins or solder pins allows the switch housing to be brought into a desired oblique position relative to the circuit board or other fastening supports. The switch is therefore also effective as an inclination switch which actuates different functions at specifically defined inclined positions.

According to yet a further aspect of the invention, a plurality of switch housings having integrated pendulum frames, permanent magnets and possibly additional bodies and associated reed switches that form a functional unit are accommodated in a common protective housing. Here the functional units have mutually parallel pendulum planes, with, however, the individual switches being arranged in different angular positions relative to the base plate of the protective housing. Thus there are different thresholds to initiate certain functions. In this way it is possible to combine several functionally independent switches into a structural unit.

Particularly, if several functional units or switches are arranged next to one another in a protective housing, a narrow configuration of the individual switches is of advantage in keeping the structural volume of the protective housing itself small.

The invention provides advantageous possibilities for realizing different inclined or angular positions of individual switches by technically simple means. The fixing of the switch housing to the fixing axis is preferably done by friction so as to produce a mechanically stable attachment.

According another aspect of the invention the individual functional units or switches are arranged in one protective housing in different spatial directions so that the total element is able to measure or at least detect inclinations, accelerations or decelerations in different directions. In this way, an entire cascade of switches of different sensitivities can be formed. Such switch combinations can also be employed, for example, as threshold generators for an ABS [anti-locking brake system] system in motor vehicles.

The invention provides for the mechanically stable final fixing of switches arranged in a protective housing. In this way, the geometric orientation of the pendulum plane of a switch always remains the same. This ensures the initiation of certain functions at initially set limit or threshold values over the entire service life of the switches.

In order to further attenuate the oscillations of the pendulum frame, the switch housing is filled with a damping fluid. The efficiency of the damping here depends on the quantity as well as the viscosity of the damping fluid. The construction of the switch housing provides for; economical and simple manufacture. Without additional aids such as, for example, further connecting elements, the switch housing can be installed with ease.

BRIEF DESCRIPTION OF THE DRAWINGS

The invention will now be described in greater detail for embodiments thereof that are illustrated in the drawing figures, in which:

FIG. 1 is a top view of a switch that is open on one side;

FIG. 2 is a sectional side view of the closed switch seen along the section line II—II of FIG. 1;

FIG. 3 is a top view of the pendulum frame;

FIG. 4 is a side view of the pendulum frame;

FIG. 5 is a rear view of the pendulum frame;

FIG. 8 is a top view of a housing shell for the switch of FIG. 1;

FIG. 9 is a sectional side view of the housing shell seen along sectional line 1X—IX of FIG. 8;

FIG. 10 is a top view of a second housing shell for the switch of FIG. 1;

FIG. 11 is a sectional side view of the housing shell seen along section line XI—XI of FIG. 10;

DETAILED DESCRIPTION OF THE PREFERRED EMBODIMENTS

Figure 6:
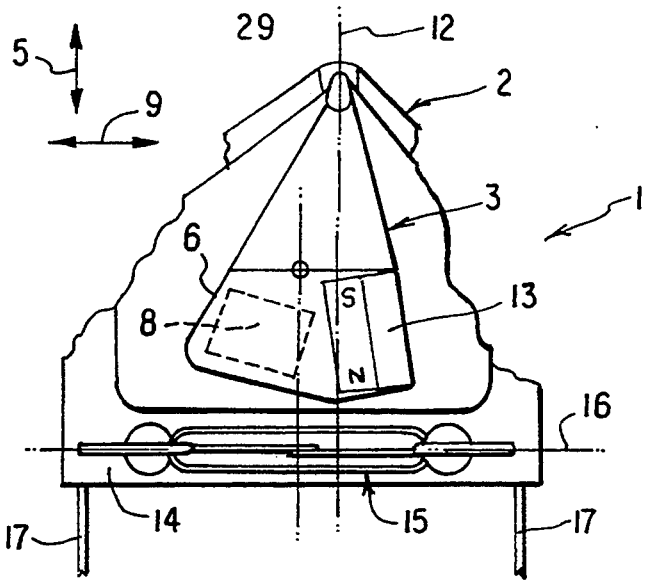
FIG. 6 is a top view of a further embodiment of the switch.

In FIG. 1, a switch 1 can be seen which has a housing shell that acts as bottom shell 2. Bottom shell 2 has approximately the outline of an isosceles triangle. However, the connecting region of the two sides of the triangle opposite its base is rounded in the manner of the arc of a circle. In this region, a pendulum frame 3 is stationarily fixed to a pendulum axis 4. By means of pendulum axis 4, pendulum frame 3 is mounted so as to be pivotal in the switch housing. Opposite pendulum axis 4 in the height direction 5 of switch 1, a pendulum housing 6 is shaped in one piece to pendulum frame 3. Starting from pendulum axis 4 in the direction of pendulum housing 6, pendulum frame 3 has an outline that is widened in the manner of a cone. A body 8 is inserted in a form locking manner into a receiving space 7 of pendulum housing 6. In FIG. 1, body 8 has a square outline. It may be, for example, a brass block. The attenuation behavior of pendulum frame 3 can be varied by bodies 8 having the same dimensions but different masses.

Pendulum housing 6 is penetrated on one side in a length direction 9 of switch 1 by a passage bore 10. A fixing bore 11 extending in length direction 9 partially penetrates body 8. Bore 11 extends along length direction 9 somewhat beyond the longitudinal axis 12 of the pendulum which extends parallel to height direction 5.

Seen in length direction 9, passage bore 10 and fixing bore 11 are congruent and serve to form-lockingly accommodate and fix a permanent magnet 13 which is configured as a cylindrical rod magnet. Its polarization direction extends parallel to length direction 9.

A reed switch 15 having a longitudinal axis 16 that extends parallel to length direction 9 is disposed between pendulum housing 6 and the side wall of bottom shell 2 which acts as a base wall 14 and extends in length direction 9. Longitudinal axis 16 and pendulum longitudinal axis 12 are arranged perpendicular to one another. Reed switch 15 is disposed approximately the same amount on both sides of pendulum longitudinal axis 12.

The connecting wires 17 of reed switch 15 are fixed to clamping projections 18 on bottom shell 2. Clamping projections 18 are preferably shaped in one piece to bottom shell 2 and extend parallel to depth direction 19 in the interior 21 of the switch housing which is defined by bottom shell 2 and a cover shell 20 (FIG. 2). Connecting wire 17 is clamped in between the two clamping ends, circular in FIG. 1, of a clamping projection 18. Immediately next to clamping projection 18, connecting wire 17 is bent over to extend in height direction 5. In order to stationarily fix connecting wires 17 also in depth direction 19, clamping projections 18 of bottom shell 2 and two further clamping projections 18 of cover shell 20, lie against one another with their mutually facing surfaces when switch 1 is installed (FIG. 2). In this way, reed switch 15 is mounted with sufficient stability.

The switching state of reed switch 15 is influenced by the pendulum oscillations of permanent magnet 13. The pendulum plane is here defined by height direction 5 and length direction 9 which is perpendicular thereto. Pendulum frame 3 in its pendulum movement describes a circle segment that is delimited by the side walls of the switch housing.

Figure 12:
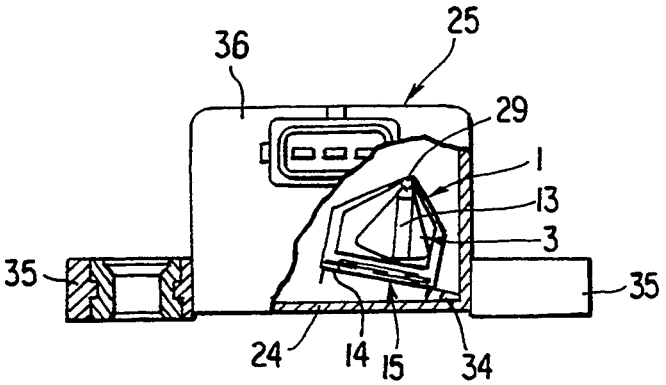
FIG. 12 is a side view, partially cut open, of the protective housing accommodating one or a plurality of switches.

A shell extension 22 is shaped in one piece to the base wall 14 of bottom shell 2 so as to extend in height direction 5. It lies in a plane defined by height direction 5 and length direction 9. The two peripheral edges of shell extension 22 projecting from base wall 14 together with base wall 14 itself form an isosceles triangle, with the angle enclosed by the peripheral edges of shell extension 22 opposite base wall 14 in height direction 5 being an obtuse angle. In the region of this angle, the outer edge of shell extension 22 is rounded. In this region, shell extension 22 is initially rectangular in height direction 5 and then immediately thereafter is cut in to form a circular switch bearing 23. Switch bearing 23 breaks through shell extension 22 in depth direction 19 (FIG. 2) and grips, preferably in a friction lock, around a fixing axis, not shown here, to support the switch housing. The switch housing can be pivoted about the fixing axis so that different inclined positions can be set between the base wall 14 and the base plate 24 of a protective housing 25 (FIG. 12).

Between switch bearing 23 and base wall 14, a wire bore 26 which is smaller than switch bearing 23 penetrates shell extension 22. The bore serves for the passage of connecting wire 17. A wire bore 26 in cover shell 20 is provided for a second connecting wire 17. If the ends of the connecting wires 17 of switch 1 are soldered to a printed circuit board, the inclination of base wall 14 and thus of the entire switch 1 can be set or changed by pivoting the latter about an imaginary pivot axis that passes through wire bore 26 in depth direction 19.

A bearing plate 27 fixed to bottom shell 2 and another bearing plate 27 fixed to cover shell 20 are provided to pivotally support pendulum axis 4 (FIG. 2). Bearing plates 27 are arranged parallel to one another and extend in height direction 5. They lie directly against projections that project into interior 21 and are stationarily fixed to two cylindrical fixing pins 28. The projections and fixing pins 28 are preferably one-piece components of bottom shell 2 and cover shell 20, respectively. Along depth direction 19, bearing plate 27 is penetrated by a bore that acts as a pendulum axis bearing 29. The two pendulum axis bearings 29 serve to pivotally fix pendulum axis 4.

FIGS. 3 to 5 indicate that pendulum frame 3, except for passage bore 10, is a symmetrical component. FIG. 3 shows that the receiving space 7 for body 8 is freely accessible from the plane of the drawing. In this way, body 8 can be subsequently inserted into pendulum frame 3. Receiving space 7 can be divided into two partial regions. In the plane of FIG. 3, the partial region of receiving space 7 facing away from the hollow cylindrical pendulum bearing 30 through which passes pendulum axis 4 has a rectangular outline. It is followed by a trapezoidal partial region that conically tapers in the direction of pendulum bearing 30. The first partial region is enlarged relative to body 8 in length direction 9. However, the dimensions of the peripheral edges of the second partial regions are such that the two corner edges of the hexagonal pendulum housing 6 facing pendulum bearing 30 cooperate with the side wall that lies opposite them in height direction 5 and clamp body 8 between them (FIG. 1). For a mechanically stable clamping connection, the elasticity of the pendulum frame 3, which is configured as a plastic injection molded component, can be utilized. The spacing of the interior walls of pendulum housing 6 facing one another in height direction 5 may be dimensioned slightly smaller than the corresponding extent of body 8 in order to realize its stationary fixing.

FIG. 6 shows a further embodiment of switch 1. Reed switch 15 is integrated in the base wall 14 of bottom shell 2. Its longitudinal axis 16 extends perpendicular to pendulum longitudinal axis 12. Pendulum longitudinal axis 12 and the polarization direction of permanent magnet 13, however, do not extend, as in FIG. 1, perpendicular to one another but form an acute angle. Body 8 and permanent magnet 13 are stationarily fixed next to one another in pendulum housing 6.

Figure 7:
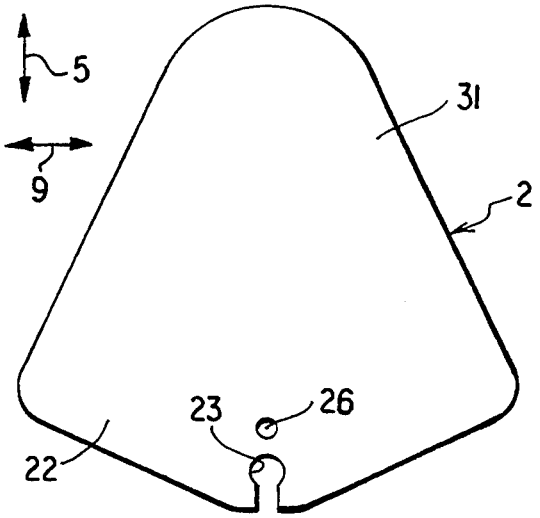
FIG. 7 is a rear view of the switch of FIG. 1.

FIG. 7 shows an approximately bell-shaped outline for bottom shell 2 and its exterior wall 31. It can also be seen that the exterior wall 31 and the exterior face of shell extension 22 lie in one plane, that is, the plane defined by height direction 5 and length direction 9. The same applies for the exterior wall 31 of cover shell 20.

FIGS. 8 to 11 indicate that bottom shell 2 and cover shell 20 are of identical configuration with respect to their significant functional components. Moreover, bottom shell 2 and cover shell 20 are symmetrical with respect to pendulum longitudinal axis 12. This significantly simplifies the manufacture of the switch housing.

Bottom shell 2 and cover shell 20 are produced as injection molded plastic components. Both housing shells differ from one another essentially in the configuration of the edges of their shell side walls which lie against one another when switch 1 is installed. The side walls of bottom shell 2 are cut out over the entire periphery of bottom shell 2, in their surface region to be contacted with cover shell 20, in the form of an interior groove 32 that forms a step. The side walls of cover shell 20 are cut out over the entire periphery of cover shell 20, in their surface region to be contacted with bottom shell 2, in the form of an exterior groove 33 that forms a step on the exterior face. Interior groove 32 and exterior groove 33 have such dimensions that bottom shell 2 and cover shell 20 are resiliently latched with one another during the installation of switch 1.

FIG. 12 depicts an embodiment in which several switches 1, each surrounded by their own switch housing, are installed in a common protective housing 25. Protective housing 25 is shown partially cut open so that a switch 1 installed in the interior of protective housing 25 is visible. This switch 1 is arranged in an inclined position within protective housing 25 so that its base wall 14 forms an angle 34 with the base plate 24 of protective housing 25, with the angle being set depending on the desired response limit value of switch 1. By means of lateral fastening means 35 which, in FIG. 12, are configured as bores for a screw attachment, protective housing 25 is stationarily fixed to the reference system to be moved.

In FIG. 12, protective housing 25 is a cup-shaped housing in which base plate 24 is the bottom of the cup which is followed by side walls and a cup cover 36 that grips over the cup in the manner of a hood and covers it. A fixing axis for setting the inclination of the switch housings is not provided in the embodiment of FIG. 12. Rather, the individual switches 1 are seated on a small plate twisted and/or inclined with the aid of their connecting wires 17 so as to realize different spatial directions and inclined positions for the individual switches 1. The interior of the cup with base plate 24 as cup bottom is filled with an injectable substance, for example, up to half the height of the cup. Cup cover 36 is placed onto the cup and the entire protective housing 25 is rotated about 180° so that now cup cover 36 forms the bottom. In this way, the contacting faces of cup and cup cover 36 are wetted by the still liquid injection substance. After the injection substance has hardened, the cup and cup cover 36 are connected with one another in a mechanically stable manner and switches 1 are permanently fixed.

What is claimed is:

1. A switch for signalling changes in position and acceleration of its housing, comprising:

a switch housing;

a permanent magnet movably mounted in said switch housing and being suspended in the manner of a planar pendulum for oscillatory movement about a pendulum axis in a pendulum plane; and a reed switch disposed in said switch housing below circle segment described by the pendulum in an effective range of the magnetic field of said permanent magnet, said reed switch having a longitudinal axis that is oriented approximately in the direction of the pendulum oscillations.

2. A switch according to claim 1, wherein the permanent magnet has a polarization direction that lies in the pendulum plane.

3. A switch according to claim 2, wherein the polarization direction extends approximately perpendicular to the longitudinal axis of the reed switch.

4. A switch according to claim 2, wherein the polarization direction extends approximately parallel to the longitudinal axis of the reed switch.

5. A switch according to claim 1, wherein the permanent magnet is a rod magnet.

6. A switch according claim 1, further comprising a pendulum frame disposed within said switch housing, the permanent magnet being disposed at said pendulum frame.

7. A switch according to claim 6, wherein the pendulum frame is a plastic injection molded component and includes a pendulum housing for accommodating the permanent magnet.

8. A switch according to claim 7, further comprising at least one further body, in addition to the permanent magnet disposed at the pendulum frame in the pendulum housing.

9. A switch according to claim 8, wherein the further body lies in a form locking manner within the pendulum housing.

10. A switch according to claim 8, wherein the further body has a fixing bore, and the permanent magnet lies form-lockingly in the fixing bore that penetrates the further body.

11. A switch according to claim 6, wherein the pendulum frame together with the permanent magnet, on the one hand, and the reed switch, on the other hand, are combined into a structural unit in said switch housing.

12. A switch according to claim 11, wherein the switch housing includes connecting elements in the form of connector pins, solder pins, or cables.

13. A switch according to claim 11, further comprising a common protective housing, a plurality of said structural units and a plurality of said switch housings, each said switch housing forming a functional unit with a respective one of said structural units and being disposed in the common protective housing.

14. A switch according to claim 11, further comprising a common protective housing having a base plate and at least one functional unit composed of a said switch housing and a said structural unit therein disposed in said common protective housing, with the switch housing together with the components of said at least one functional unit disposed in said common protective housing being arranged in an inclined position relative to the base plate of the protective housing so as to set a desired response threshold.

15. A switch according to claim 14, wherein the switch housing of said at least one functional unit includes a switch bearing having a fixing axis that is parallel to the pendulum axis and the inclination of the functional unit can be adjusted by pivoting the switch housing about the fixing axis.

16. A switch according to claim 15, wherein the switch bearing is disposed approximately in the longitudinal direction of the pendulum axis in an end region of said switch housing opposite the pendulum axis.

17. A switch according to claim 13, wherein the functional units are arranged so that their pendulum planes are oriented in different spatial directions.

18. A switch according to claim 13, wherein the switch housings are arranged in said common protective housing in inclined positions and are encased in said common protective housing so as to permanently fix the inclined positions of said switch housings.

19. A switch according to claim 1, wherein the switch housing is filled completely or in part with a damping fluid.

20. A switch according to claim 1, wherein the switch housing is a two-shell plastic injection molded component including two resiliently latchable housing shells; and an interior defined by the housing shells for accommodating the pendulum frame and the permanent magnet, said housing shells having a an approximate central parting plane which is substantially coincident with the pendulum plane.

* * * * *